US009976803B2

(12) United States Patent
Asse et al.

(10) Patent No.: US 9,976,803 B2
(45) Date of Patent: May 22, 2018

(54) PROCESS AND APPARATUS FOR PRODUCING GASEOUS OXYGEN BY CRYOGENIC DISTILLATION OF AIR

(71) Applicant: L'Air Liquide, Societe Anonyme pour l'Etude et l'Exploitation des Procedes Georges Claude, Paris (FR)

(72) Inventors: Alexis Asse, Paris (FR); Ingrid Berthaume, Ormesson sur Marne (FR); Alain Briglia, Hangzhou (CN); Richard Dubettier-Grenier, La Varenne Saint Hilaire (FR); Patrick Le Bot, Vincennes (FR); Jean-Marc Peyron, Creteil (FR)

(73) Assignee: L'AIR LIQUIDE SOCIETE ANONYME POUR L'ETUDE ET L'EXPLOITATTION DES PROCEDES GEORGES CLAUDE, Paris (FR)

( * ) Notice: Subject to any disclaimer, the term of this patent is extended or adjusted under 35 U.S.C. 154(b) by 85 days.

(21) Appl. No.: 15/022,314

(22) PCT Filed: Sep. 9, 2014

(86) PCT No.: PCT/FR2014/052228
§ 371 (c)(1),
(2) Date: Mar. 16, 2016

(87) PCT Pub. No.: WO2015/040306
PCT Pub. Date: Mar. 26, 2015

(65) Prior Publication Data

US 2016/0231053 A1 Aug. 11, 2016

(30) Foreign Application Priority Data

Sep. 17, 2013 (FR) ..... 13 58927

(51) Int. Cl.
*F25J 3/00* (2006.01)
*F25J 3/04* (2006.01)

(52) U.S. Cl.
CPC ..... *F25J 3/04412* (2013.01); *F25J 3/0409* (2013.01); *F25J 3/04024* (2013.01);
(Continued)

(58) Field of Classification Search
CPC .. F25J 3/04412; F25J 3/04218; F25J 3/04775; F25J 3/04781; F25J 3/04024;
(Continued)

(56) References Cited

U.S. PATENT DOCUMENTS 5,475,980 A 12/1995 Grenier et al.
2006/0277944 A1* 12/2006 Le Bot ..... F25J 3/04054 62/646
2009/0064714 A1* 3/2009 Rottmann ..... F25J 3/04054 62/642

FOREIGN PATENT DOCUMENTS

DE 102007014643 9/2007
EP 2 015 012 1/2009
(Continued)

OTHER PUBLICATIONS

International Search Report and Written Opinion for PCT/FR2014/052228, dated May 4, 2015.

*Primary Examiner* — Keith Raymond
(74) *Attorney, Agent, or Firm* — Justin K. Murray

(57) ABSTRACT

Process for producing gaseous oxygen by cryogenic distillation of air, wherein a portion of the feed air flow is brought to a pressure $P_1$, by means of a first compressor, the suction temperature $T_0$ of which is between 0 and 50° C., the gas at the pressure $P_1$ is cooled, in order to generate an air stream at the pressure $P_1$ and the temperature T1 between 5 and 45° C., a portion of the air compressed in the first compressor undergoes an additional compression step starting from the
(Continued)

temperature $T_1$ and pressure $P_1$ to a pressure $P_2$ greater than $P_1$, then is cooled, to the temperature $T_2$ where $T_2$ and $T_1$ differ by less than 10° C.

10 Claims, 3 Drawing Sheets

(52) U.S. Cl.
CPC ..... *F25J 3/04054* (2013.01); *F25J 3/04175* (2013.01); *F25J 3/04218* (2013.01); *F25J 3/04296* (2013.01); *F25J 3/04303* (2013.01); *F25J 3/04309* (2013.01); *F25J 3/04381* (2013.01); *F25J 3/04387* (2013.01); *F25J 3/04393* (2013.01); *F25J 3/04775* (2013.01); *F25J 3/04781* (2013.01); *F25J 2210/06* (2013.01); *F25J 2230/08* (2013.01); *F25J 2230/20* (2013.01); *F25J 2230/24* (2013.01); *F25J 2230/30* (2013.01); *F25J 2230/40* (2013.01); *F25J 2240/10* (2013.01)

(58) Field of Classification Search
CPC .. F25J 3/04054; F25J 3/04393; F25J 3/04381; F25J 3/04296; F25J 3/04303; F25J 2210/06; F25J 2230/08; F25J 2230/20; F25J 2230/24; F25J 2230/30; F25J 2230/40
See application file for complete search history.

(56) References Cited

FOREIGN PATENT DOCUMENTS

| | | |
|---|---|---|
| EP | 2 369 281 | 9/2011 |
| EP | 2 597 409 | 5/2013 |
| FR | 2 943 408 | 9/2010 |

* cited by examiner

PROCESS AND APPARATUS FOR PRODUCING GASEOUS OXYGEN BY CRYOGENIC DISTILLATION OF AIR

CROSS REFERENCE TO RELATED APPLICATIONS

This application is a § 371 of International PCT Application PCT/FR2014/052228, filed Sep. 9, 2014, which claims the benefit of FR1358927, filed Sep. 17, 2013, both of which are herein incorporated by reference in their entireties.

TECHNICAL FIELD OF THE INVENTION

The present invention relates to a process and to an apparatus for producing gaseous oxygen by cryogenic distillation of air.

SUMMARY OF THE INVENTION

One subject of the invention is the improvement in the energy performance of an air separation unit producing a gas, generally oxygen, at a pressure above 20 bar a, by vaporization of the main exchanger of liquid oxygen, drawn from the distillation columns and brought to high pressure by means of a pump.

In the units for producing oxygen by vaporization of liquid, the energy efficiency of the plant depends to a large extent on the method used for generating the hot pressurized fluid, generally feed air, which, by condensing toward the cold end of the exchanger, will enable the vaporization of the oxygen by exchange of heat.

U.S. Pat. No. 5,475,980 describes an air separation process in which a portion of the air is compressed in a hot booster and another portion in a cold booster until substantially identical pressure is reached. The cold compression gives rise to an introduction of compression heat into the heat exchanger. However a portion of the air boosted in the cold booster is expanded in an expansion turbine. For this reason, it is not possible to reduce the cold-boosted flow below a certain value since the air available for the expansion would be insufficient.

In certain embodiments of the present invention, the air stream sent to the turbine has not been boosted in the cold booster and thus it is possible to minimize the amount of compression heat.

All the pressures mentioned are absolute pressures.

The invention proposes a particularly effective method for generating this pressurized gas, by the succession of several operations.

According to one subject of the invention, a process is provided for producing gaseous oxygen by cryogenic distillation of air, wherein:

i) all or part of the feed air flow is brought to a pressure P1, at least 5 bar greater than the pressure of the medium-pressure column, by means of a first compressor, the suction temperature T0 of which is between 0 and 50° C., preferably between 5 and 30° C., ii) the gas at the pressure P1 is cooled, typically by heat exchange with water, in order to generate an air stream at the pressure P1 and the temperature T1 between 5 and 45° C., preferably between 15 and 25° C., iii) a portion of the air compressed in the first compressor undergoes an additional compression step starting from the temperature T1 and pressure P1 to a pressure P2 greater than P1, then is cooled, typically by heat exchange with water, to the temperature T2 where T2 and T1 differ by less than 10° C., typically less than 5° C., iv) this cooled portion is then introduced into a heat exchanger of an air separation unit in order to undergo cooling to a temperature below or equal to −100° C., v) another portion of the air is introduced at the pressure P1 into a heat exchanger of the air separation unit, optionally that from step iv), in order to undergo cooling therein to a temperature below −100° C., then at least one fraction of this other portion is compressed starting from this cryogenic temperature in a second compressor (4) to a pressure P3 which is either equal to P2, or is less than 5 bar higher or lower than P2, vi) the fraction thus compressed in the second compressor is sent back to one of the previous exchangers or to the exchanger in order to be cooled therein to a temperature below −100° C., vii) at least one portion of the air at the pressure P2 and at least one portion of the air at the pressure P3 and optionally at least one portion of the stream at the pressure P1 are cooled up to the cold end of the exchanger where they are liquefied, then are sent after expansion to at least one distillation column of the air separation unit, viii) at least 50%, preferably at least 70%, of the total air flow supplies, in gaseous form, at least one distillation column of the unit, after having been expanded in an expansion turbine, ix) air is separated in the system of columns, and x) liquid oxygen is drawn from one of the distillation columns, pressurized by means of a pump to the required pressure which is greater than 20 bar abs, vaporized by heat exchange, then reheated in order to be used in the form of gaseous product, wherein the air is expanded in the expansion turbine starting from the pressure P1 or P2 or from a pressure between P1 and P2.

According to other optional aspects of the invention:

- a third portion of the air at a pressure less than P1 is cooled in the exchanger and is sent to the distillation,
- the second compressor is coupled to another expansion turbine,
- the separation unit comprises a medium-pressure column and a low-pressure column and a nitrogen-enriched gas from the medium-pressure column is expanded in a turbine,
- the second compressor is coupled to a turbine and a system for supplying or extracting additional or surplus power is incorporated between the turbine and the second compressor, either directly on the common shaft of the turbine/second compressor, or by means of a gearbox,
- the fraction compressed in the second compressor and the portion that undergoes an additional compression are re-mixed in the exchanger of the air separation unit so as to form only a single flow at the pressure P2,
- the pressure P3 is at most 2 bar higher or lower than P2,
- at least one portion of the gaseous air sent to the distillation columns was expanded in a turbine starting from the pressure P1 or from an intermediate pressure between P1 and P2,
- at least one portion of the gaseous air sent to the distillation columns was expanded in a turbine starting from the pressure P2,
- the pressure P1 is between 20 and 25 bar,
- the pressure P2 is between 50 and 60 bar,
- the pressure P3 is between 50 and 60 bar, the fraction of air compressed in the second compressor is compressed to the pressure P2 and is mixed with the portion of the air at the pressure P2 in order to be cooled in the heat exchanger.

According to another subject of the invention, an apparatus is provided for producing gaseous oxygen by cryogenic distillation of air that comprises a system of columns, a first compressor, a second compressor, at least one heat exchanger, means for sending all or part of the feed air flow to the first compressor capable of bringing its pressure to a pressure P1, at least 5 bar greater than the pressure of the medium-pressure column, a first cooler for cooling the gas at the pressure P1, typically by heat exchange with water, in order to generate an air stream at the pressure P1 and the temperature T1 between 5 and 45° C., preferably between 15 and 25° C., means for compressing a portion of the air compressed in the first compressor at the pressure P1 to a pressure P2 greater than P1, a second cooler for cooling the portion of the air at P2, to the temperature T2 where T2 and T1 differ by less than 10° C., typically less than 5° C., means for sending this cooled portion to the or one of the heat exchanger(s) in order to undergo cooling to a temperature below or equal to −100° C., means for introducing another portion of the air at the pressure P1 into the or one of the heat exchanger(s) of the air separation unit, in order to undergo cooling therein to a temperature below −100° C., means for sending at least one fraction of this other portion to the second compressor starting from this cryogenic temperature in a second compressor to a pressure P3 which is either equal to P2, or is less than 5 bar higher or lower than P2, means for sending back the fraction thus compressed in the second compressor to one of the previous exchangers or to the exchanger in order to be cooled therein to a temperature below −100° C., means for sending at least one liquefied gas at the pressure P1 and/or at the pressure P2 and/or at the pressure P3 to at least one distillation column of the air separation unit, an expansion turbine capable of expanding at least 50%, preferably at least 70%, of the total air flow connected to at least one column of the system and means for drawing off liquid oxygen from a column of the system, a pump for pressurizing the liquid and means for sending the pumped liquid to the/one of the heat exchanger(s), characterized in that the expansion turbine is connected to the outlet of the first compressor in order to receive air that originates therefrom but is connected so that it does not receive air from the second compressor.

According to other optional aspects of the invention:

the means for boosting a portion of the air at the pressure P2 consist of a compressor, the outlet of the second compressor and the outlet of the means for boosting a portion of the air at the pressure P2 are connected to at least one common passage of the heat exchanger in order to cool the two air flows boosted in the second compressor and the boosting means, the second compressor is coupled to a turbine other than the air turbine, the second compressor is coupled to a nitrogen turbine fed by the system of columns.

All or part of the feed air flow is brought to a pressure P1, at least 5 bar greater than the medium-pressure column, by means of a compressor, the suction temperature T0 of which is between 0 and 50° C., preferably between 5 and 30° C. At the outlet of the compressor, the gas is cooled, typically by heat exchange with water, in order to generate an air stream at the pressure P1 and the temperature T1 between 5 and 45° C., preferably between 15 and 25° C.

A portion of this stream undergoes an additional compression step starting from the temperature T1 and pressure P1 to a pressure P2 greater than P1, then is cooled, typically by heat exchange with water, to the temperature T2. T2 and T1 only differ by less than 10° C., typically less than 5° C. This flow is then introduced into an exchanger E1 of the air separation unit in order to undergo cooling to a temperature below or equal to −100° C.

Another portion of this stream is introduced at the pressure P1 and at the temperature T1 into an exchanger of the air separation unit, optionally E1, in order to undergo cooling therein to a temperature below −100° C., then at least one fraction of this portion is compressed starting from this cryogenic temperature in a compressor to a pressure equal to P2, or that differs by less than 5 bar from P2. The flow thus compressed is sent back to one of the previous exchangers in order to be cooled therein to a temperature below −100° C.

At least one portion of each of the flows brought to a high pressure is cooled to the cold end of the exchanger where they are liquefied, then are sent after expansion to the distillation columns.

Optionally, a third portion of the flow at the temperature T1 and at the pressure P1 is sent to an exchanger of the air separation unit.

At least 50%, preferably at least 70%, of the total air flow supplies, in gaseous form, the distillation columns of the unit, optionally after having been expanded from one of the pressures mentioned above in an expansion turbine.

Liquid is drawn off from the distillation columns, pressurized by means of a pump to the required pressure, vaporized by heat exchange, in particular during step 4), then reheated in order to be used in the form of gaseous product.

The compression of the pressurized stream starting from the cryogenic temperature as described below takes place in a booster coupled to an expansion turbine.

A nitrogen-enriched gas from the medium-pressure column is expanded in a turbine in order to achieve this compression.

The power supplied by the turbine differs significantly from the power required by the cryogenic compressor, so that a system of supplying (respectively extracting) additional (respectively surplus) power is incorporated between the turbine and the booster, either directly on the common shaft of the turbine/booster, or by means of a gearbox.

The flows at the pressure P2 which are generated are re-mixed in the exchanger of the air separation unit so as to form only a single flow at the pressure P2.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

DETAILED DESCRIPTION

The invention will be described in a more detailed manner by referring to the figures that represent processes according to the invention.

Figure 1:
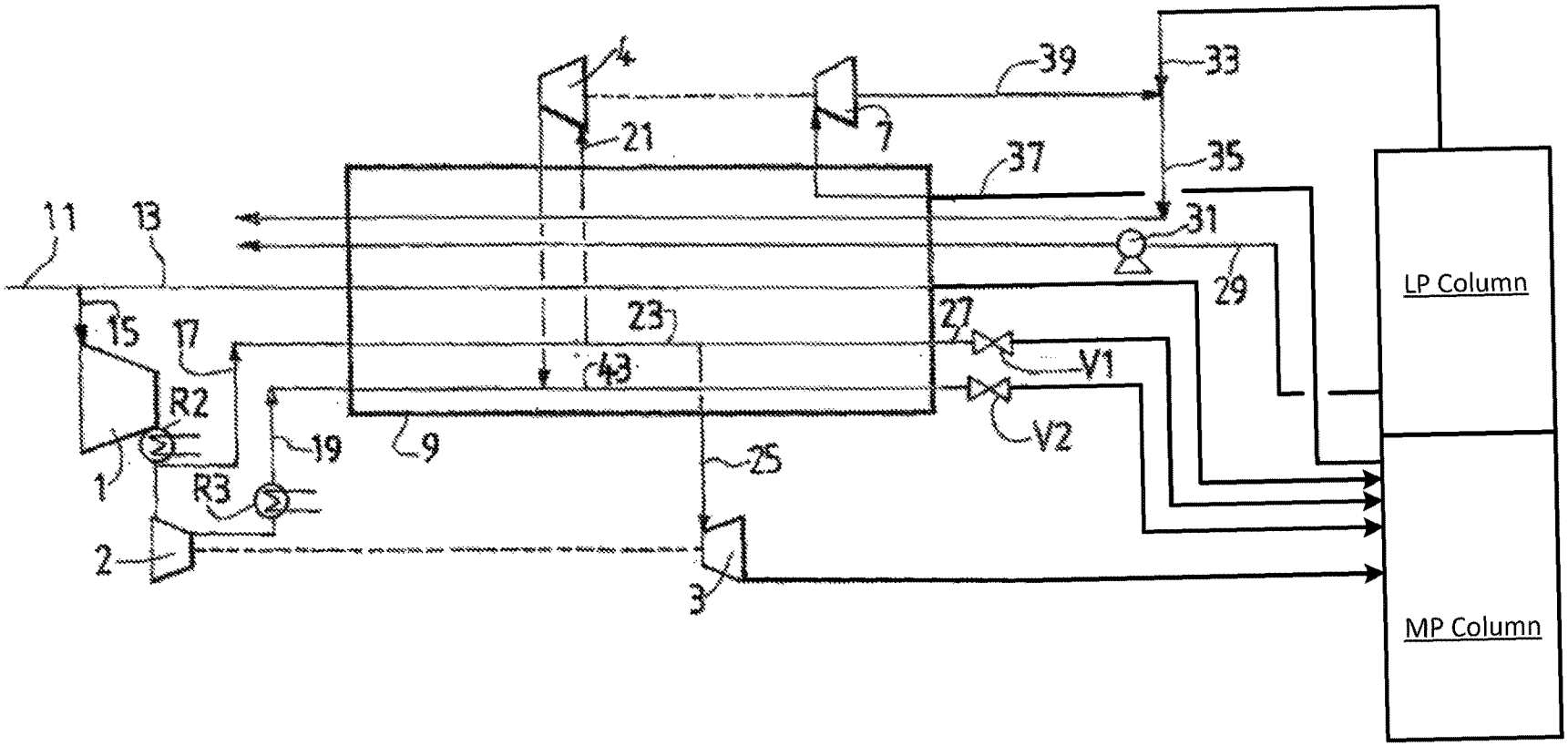
FIG. 1 represents a heat exchange portion of a cryogenic distillation apparatus for air separation in accordance with an embodiment of the present invention.
Figure 2:
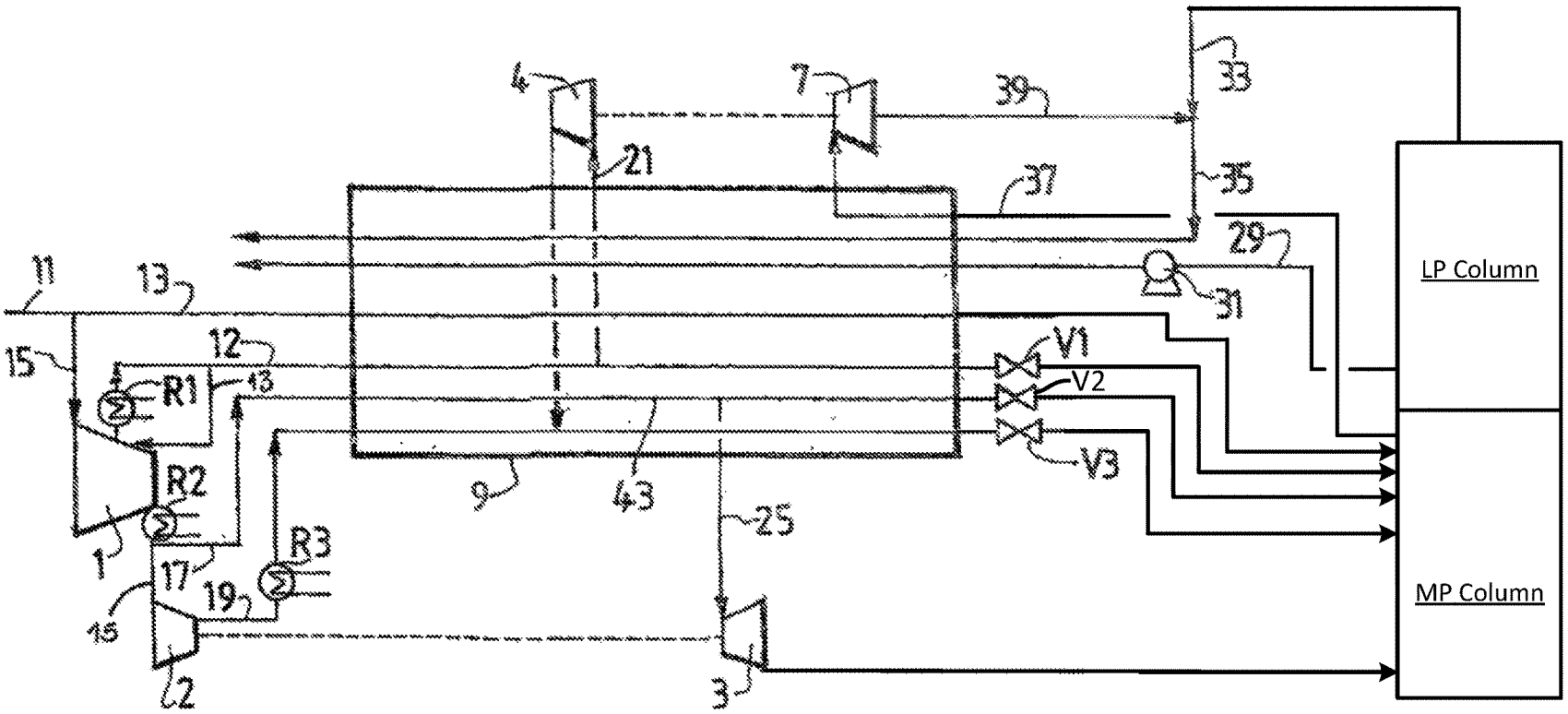
FIG. 2 represents a heat exchange portion of a cryogenic distillation apparatus for air separation in accordance with an embodiment of the present invention.

FIG. 1 and FIG. 2 represent the heat exchange portion of cryogenic distillation apparatus for air separation.

Figure 3:
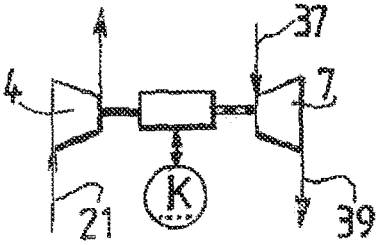
FIG. 3 represents an embodiment of the present invention.
Figure 4:
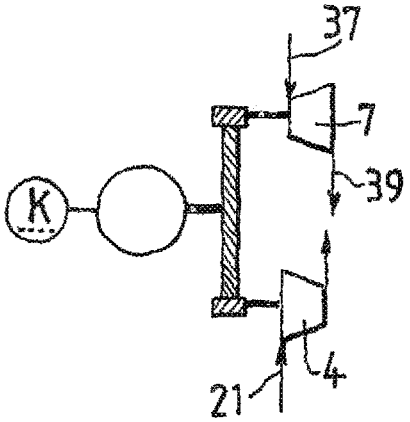
FIG. 4 represents an embodiment of the present invention.

FIGS. 3 and 4 represent ways of positioning a cold booster and a turbine.

For simplification, the figures do not show the air separation apparatus which comprises at least one double column comprising a medium-pressure column and a low-pressure column, the top of the medium-pressure column being thermally coupled with the bottom of the low-pressure column. Air is sent to the medium-pressure column and optionally to the low-pressure column. Reflux liquids enriched in oxygen and in nitrogen are sent from the medium-pressure column to the low-pressure column.

An oxygen-enriched liquid is drawn off from the bottom of the low-pressure column and is vaporized in the exchanger where the air is cooled.

In FIG. 1, air 11 at a pressure P0 is purified. A portion 15 of the feed air flow 11 is brought to a pressure P1, at least 5 bar greater than the pressure of the medium-pressure column, by means of a compressor 1, the suction temperature T0 of which is between 0 and 50° C., preferably between 5 and 30° C. At the outlet of the compressor 1, the gas is cooled in a cooler R2, typically by heat exchange with water, in order to generate an air stream at the pressure P1 and the temperature T1 between 5 and 45° C., preferably between 15 and 25° C.

A portion of this stream undergoes an additional compression step in a compressor 2 starting from the temperature T1 and pressure P1 to a pressure P2 greater than P1, then is cooled in a cooler R3, typically by heat exchange with water, to the temperature T2. T2 and T1 differ by less than 10° C., typically less than 5° C. This cooled flow 19 is then introduced into a heat exchanger 9 of the air separation unit in order to undergo cooling to a temperature below or equal to −100° C.

Another portion 17 of this flow is introduced at the pressure P1 and at the temperature T1 into the exchanger 9, in order to undergo cooling therein to a temperature below −100° C. Then a fraction 21 of the portion 17 is compressed starting from this cryogenic temperature in a compressor 4 to a pressure P3 equal to P2. The flow thus compressed is sent back to the exchanger E1 in order to be cooled therein to a temperature below −100° C.

A portion 43 of the flow 19 and a portion 27 of the fraction 17, 23 are cooled up to the cold end of the exchanger 9 where they are liquefied, then are sent after expansion in the valves V1, V2 to the double column.

At least 50%, preferably at least 70%, of the total air flow 11 supplies, as flow 25 in gaseous form, the distillation columns of the unit. A portion 25 of the air at the pressure P1 is expanded in an expansion turbine 3. The expansion turbine has an inlet temperature lower than that of the compressor 4.

Liquid oxygen 29 is drawn from the low-pressure column, pressurized by means of a pump 31 to the required pressure, vaporized by heat exchange in the exchanger 9, then reheated in order to be used in the form of gaseous product.

Medium-pressure nitrogen 37 originating from the medium-pressure column is reheated in the exchanger 9, is expanded in the turbine 7 and is sent as flow 39 to be mixed with the low-pressure nitrogen 33 in order to form the flow 35. The flow 35 is reheated in the exchanger 9.

In FIG. 2, the air is cooled in the exchanger at four different pressures. The air at the pressure P0 of 5.5 bar is split into two, one portion 13 being cooled in the exchanger. The air 15 is cooled in the compressor 1 and at an intermediate level thereof is found at a pressure P1 of between 20 and 25 bar and a temperature T1 between 5 and 45° C., preferably between 15 and 25° C. The air at this pressure and temperature is split into two. One portion 12 is sent to the second compressor 4 at the pressure P1 between 20 and 25 bar and compressed to the highest pressure P3 between 50 and 60 bar. The remainder 13 of the air at P1 and T1 is sent back to the compressor 1 and compressed in the last stages of the compressor 1, cooled in the cooler R2 then split into two. One portion 17 is sent to the exchanger 9 where it is cooled to an intermediate temperature. At this temperature, it is split into two, one portion 25 being sent to the turbine 3 and the remainder of the air being liquefied and expanded in the valve V2. The remainder 15 of the air leaving the cooler R2 is sent to the compressor 2. The cooled air originating from the compressor 2 is at a pressure P2 between 50 and 60 bar and a temperature T2. T2 and T1 differ by less than 10° C., typically less than 5° C. The air 21 is cold compressed and is mixed with the gas 19 originating from the compressor 2 at the pressure P2, between 50 and 60 bar. The air to be expanded 25 is taken at another intermediate pressure, higher than that at which the air sent to the second compressor is taken. This intermediate pressure is the outlet pressure of the first compressor 1, between P2 and P1.

In FIG. 3, the second compressor 4 that compresses the air 21 is coupled to a nitrogen turbine 7 that expands the flow 37 in order to produce the flow 39. The system may also comprise a system for supplying or extracting additional or surplus power K incorporated between the turbine and the second compressor, directly on the common shaft of the turbine/second compressor. Otherwise, as illustrated in FIG. 4, the system K may be connected to the compressor and to the turbine by means of a gearbox.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A process for producing gaseous oxygen by cryogenic distillation of air in an air separation unit comprising a distillation column system comprised of a medium-pressure column and a low pressure column, the process comprising the steps of:

i) compressing all or part of a feed air flow to a pressure $P_1$ to form a first compressed feed air using a first compressor, wherein $P_1$ is at least 5 bar greater than the pressure of the medium-pressure column, wherein the suction temperature $T_0$ of the first compressor is between 0° C. and 50° C.;

ii) cooling the first compressed feed air in order to generate an air stream at the pressure $P_1$ and a temperature $T_1$ between 5° C. and 45° C.;

iii) splitting the air stream into a first portion and a second portion;

iv) compressing the second portion of the air stream in a second compressor to a pressure $P_2$ and then cooling the pressurized portion of the air stream to a temperature $T_2$ to form a cooled second portion, wherein $P_2$ is greater than $P_1$, wherein $T_2$ and $T_1$ differ by less than 10° C.;

v) cooling the cooled second portion to a temperature below or equal to −100° C., liquefying said cooled second portion, then expanding the liquefied cooled second portion before introduction to the distillation column system;

vi) cooling the first portion of the air stream to a cryogenic temperature below −100° C., then compressing a first fraction of the first portion starting from this cryogenic temperature in a third compressor to a pressure $P_3$ which is either at or within 5 bar of $P_2$;

vii) cooling the compressed first fraction to a temperature below −100° C., liquefying said compressed first fraction, then expanding the liquefied compressed first fraction before introduction to the distillation column system;

viii) expanding a flow of gaseous air stream in an expansion turbine and then sending the flow of gaseous air stream to at least one distillation column of the unit, wherein the flow of gaseous air stream is at a temperature below −100° C. when sent to the expansion turbine, wherein the flow of gaseous air stream comprises at least 50% of the air stream;

ix) separating air streams in the distillation column system under conditions effective for the rectification of air, wherein the air streams are comprised of air streams derived from the feed air flow; and x) withdrawing liquid oxygen from distillation column system, pressurized by a pump to a required pressure which is greater than 20 bar abs, vaporized and heated by heat exchange to form a gaseous product, wherein the expansion turbine expands the flow of gaseous air stream starting from the pressure $P_1$ or $P_2$ or from a pressure between $P_1$ and $P_2$, wherein the first fraction compressed in the third compressor and the second portion of the air stream are mixed in a heat exchanger of the air separation unit so as to form only a single flow of air within the heat exchanger at the pressure $P_2$.

2. The process as claimed in claim 1, wherein a third compressor is coupled to another expansion turbine.

3. The process as claimed in claim 1, wherein a nitrogen-enriched gas from the medium-pressure column is expanded in a nitrogen turbine.

4. The process as claimed in claim 1, wherein the third compressor is coupled to a nitrogen turbine and a system for supplying or extracting additional or surplus power is incorporated between the nitrogen turbine and the third compressor, either directly on a common shaft of the nitrogen turbine/third compressor, or by means of a gearbox.

5. The process as claimed in claim 1, wherein the pressure $P_3$ is at most 2 bar higher or lower than $P_2$.

6. The process as claimed in claim 1, wherein the flow of gaseous air stream is at a pressure less than $P_2$ when expanded in the expansion turbine.

7. The process as claimed in claim 6, wherein the flow of gaseous air stream expanded in the expansion turbine is not compressed in a compressor having an inlet temperature below the ambient temperature.

8. The process as claimed in claim 1, wherein the flow of gaseous air stream is at pressure $P_2$ when expanded in the expansion turbine.

9. The process as claimed in claim 8, wherein the flow of gaseous air stream expanded in the expansion turbine is not compressed in a compressor having an inlet temperature below the ambient temperature.

10. The process as claimed in claim 1, wherein $P_2$ is between 50 and 60 bar and/or $P_3$ is between 50 and 60 bar.

* * * * *